US005305838A

United States Patent [19]

Pauc

[11] Patent Number: 5,305,838

[45] Date of Patent: Apr. 26, 1994

[54] DEVICE COMPRISING TWO ARTICULATED ELEMENTS IN A PLANE, APPLIED TO A DRILLING EQUIPMENT

[76] Inventor: André Pauc, 59, rue Clémenceau, 78670 Villennes sur Seine, France

[21] Appl. No.: 920,445

[22] PCT Filed: Dec. 6, 1991

[86] PCT No.: PCT/FR91/00977

§ 371 Date: Aug. 26, 1992

§ 102(e) Date: Aug. 26, 1992

[87] PCT Pub. No.: WO92/12324

PCT Pub. Date: Jul. 23, 1992

[30] Foreign Application Priority Data

Dec. 28, 1990 [FR] France ..... 90 16442

[51] Int. Cl.[5] ..... E21B 7/08

[52] U.S. Cl. ..... 175/73

[58] Field of Search ..... 175/73-75; 285/118, 122, 168, 190, 272, 275

[56] References Cited

U.S. PATENT DOCUMENTS

| | | | |
|---|---|---|---|
| 4,895,214 | 1/1990 | Schoeffler | 175/73 X |
| 4,921,055 | 5/1990 | Kayes | 175/73 X |
| 4,938,297 | 7/1990 | Schmidt | 175/73 X |

*Primary Examiner*—Thuy M. Bui

*Attorney, Agent, or Firm*—Antonelli, Terry, Stout & Kraus

[57] ABSTRACT

A device for enabling two elements connected by a knuckle to take a disalignment angle with respect to one another in a single displacement plane. One of the elements is a lower element extending beyond the knuckle and is shaped as a lever arm located in the second element which forms the upper element. The knuckle is fashioned as a ball joint, with a guiding arrangement being provided for holding the displacement of the drill elements in the displacement plane. The guiding means are integrated into the upper element and, in the upper element, a control arrangement is provided for controlling the disalignment angle with the controlling arrangement including an eccentric having the positioned determined by the disalignment angle.

13 Claims, 7 Drawing Sheets

45°
0
12
13
20
25
26
27
28
29
35

DEVICE COMPRISING TWO ARTICULATED ELEMENTS IN A PLANE, APPLIED TO A DRILLING EQUIPMENT

BACKGROUND OF THE INVENTION

The present invention relates to a device comprising two articulated elements in a single plane, having means for controlling the disalignment angle of the two elements in relation to one another. One of these elements can be free to rotate around the longitudinal axis thereof, whatever the axis of the disalignment thereof in relation to the other element may be.

In the field of petroleum drilling, it is often necessary to use bent subs to deflect the drilling of the wells in a given direction while following a predetermined trajectory.

In order to have precise leading means which, at the same time, limit the time wasted handling the drill string, variable-angle bent subs adjustable from the surface are used.

In French patent A-2,432,079, a device is proposed which comprises two tubular elements assembled together, wherein the first element is rotatable around an axis forming an angle with the axis of the second element. The rotating of the first element with respect to the second element causes a disalignment of the two elements. The disalignment is maximum for a rotation through 180° and cancels out for 360°.

But the principle of this device makes the first element describe the generatrices of a cone. This brings about great drawbacks as far as the adjusting time and the precision are concerned when the trajectory of the well is wanted to or has to be maintained along a plane. In fact, if the plane defined by the axis of the upper thread of the sub and the axis of the lower element is referred to, the orientation of this plane changes for each value of the disalignment angle. It is therefore necessary to restore at each adjusting of the bend the correct orientation of this plane in order to follow the planned trajectory.

Besides, this displacement principle causes twisting moments on the drill string.

U.S. Pat. No. 3,627,356 discloses an articulated bent sub in a plane whose angle variation notably occurs through the feeding of a stiff rod through the drill string.

This device cannot be used when the gravity is not active any longer, as it is the case with strongly inclined drillings. Moreover, the diameter of the inner passageway of the circulating fluids is noticeably decreased.

The prior art illustrated by these two patents describes no articulated device enabling a notation of one of the elements of the device around the axis thereof since, when a bent sub is used in a drill string, a downhole motor is necessarily inserted between the drill bit and the lower connection of the bent sub. This moves the bend away from the drill bit accordingly and considerably decreases the deflecting effect of such a string.

SUMMARY OF THE INVENTION

The aim underlying the present invention essentially resides in providing a device for controlling the displacement angle in a single plane thereby avoiding the problems encountered in the prior art.

The device of the invention can be inserted between the drill bit and the downhole motor since the lower element can be rotated by the rotor of the motor. A downhole motor can be placed between the drill bit and the device without departing from the scope of this invention.

According to the present invention the rotation of an eccentric is employed as a means for controlling the disalignment angle of one element with respect to the other.

The present invention utilizes the principle of a ball joint knuckle, which gives the device a great mechanical strength towards thrust loads or bending stresses, since the distribution of the stresses is better there by comparison with a plane knuckle, notably a pin.

The present invention thus relates to a device allowing two elements linked by a knuckle to take disalignment angles in relation to one another, in a single plane referred to as displacement plane, with one of the elements referred to as lower element extending beyond the knuckle in the form of a lever arm located in a second hollow element referred to as upper element.

This device is characterized in that the knuckle is of the ball joint type, in that the device comprises guiding means holding the displacement of the two elements in said displacement plane, said means are integrated in the upper element, and wherein the device also comprises in the upper element means for controlling the disalignment angle and in that the control means comprise an eccentric whose position determines the angle.

The control means can comprise a substantially ring-shaped part whose inner recess, in which the lever arm is positioned, includes a straight-line section of circular shape whose center is eccentric in relation to the axis of the upper element, and at the level of the ring, the lever arm can comprise two faces symmetric in relation to the longitudinal axis thereof and perpendicular to the displacement plane of the two elements, and the recess can comprise a part guided in rotation by the recess and itself comprises a possibly oblong port cooperating with the faces of the lever arm.

The lower element can be hollow and comprise at the upper end of the lever arm a supple and tight connection cooperating with the end of a pipe allowing the fluid to circulate through the lower element.

The lower element can rotate around the axis thereof and the lever arm can cooperate with a coaxial bushing whose angular position is fixed in relation to the displacement plane.

The pipe cooperating with the upper end of the lower element can be a hollow shaft transmitting the turning moment to the lower element.

The guiding and control means can comprise systems of ports and faces and at least some of said faces can be carried by the bushing.

The part guided in rotation by said recess can comprise two identical sectors filling in the two spaces delimited by each face and the inner recess of the ring, and this recess can have the shape of a symmetric truncation of a sphere, and the sectors can be sectors of truncation of the sphere.

The upper element can comprise a driveshaft which is concentric in relation to it, and the driveshaft can be immovably attached to the ring in rotation.

The device can comprise remote control means for the means controlling the disalignment angle of the two elements.

The present invention also relates to the application of the device to an assembly notably integrated in a drill string.

The application of the device can be characterized in that the device cooperates with a drill bit screwed onto the lower element, with a downhole motor, an assembly of articulated elements, drill collars, drillpipes.

The device can also be applied to a drill string which can comprise, from the bottom up: a drill bit, said device, a downhole motor, articulated elements, drill collars, drillpipes. The downhole motor and the articulated elements can be inverted.

The device can also be applied to a drill string characterized in that it can comprise a downhole motor screwed onto the lower element of said device and in that a drill bit is then screwed onto the rotor of said motor.

BRIEF DESCRIPTION OF THE DRAWINGS

The present invention and the advantages thereof will be clear from reading the description hereafter of non limitative particular examples, with reference to the accompanying drawings wherein.

DESCRIPTION OF THE PREFERRED EMBODIMENTS

Figure 1:
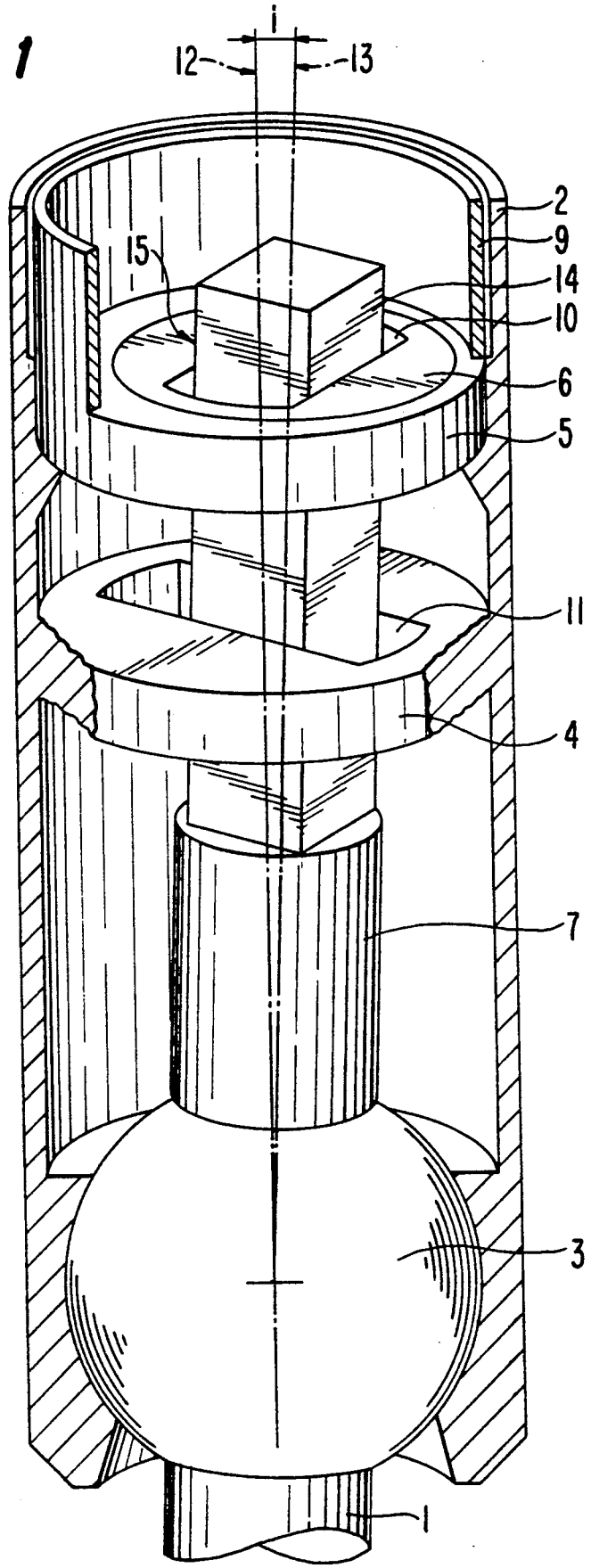
FIG. 1 is a cross-sectional schematic view of a means for guiding and controlling a disalignment angle of two elements in accordance with the present invention.

Referring now to the drawings wherein like reference numerals are used throughout the various views to designate like parts and, more particularly, to FIG. 1, according to this figure, a device for controlling the disalignment angle of two elements with respect to one another constructed in accordance with the present invention includes a lower element 1 assembled to an upper element 2 through an articulated means of a ball joint type. The lower element 1 extends beyond a knuckle 3 through a lever arm 7 having a portion of a length thereof in the shape of a regular prism whose straight-line section comprises four sides parallel to each other and whose opposite faces are perpendicular to each other. The guiding and control means are located at the level of this portion of the lever arm 7.

The guiding means 4 comprise an oblong port 11 dimensioned for guiding lever arm 7 in the displacement plane. Guiding means 4 are immovably attached to the upper element 2.

The means for controlling the disalignment angle of the two elements 1 and 2 comprise a substantially ring-shaped part 5. The outer surface of this ring 5 is concentric in the body of the upper element 2 and free in rotation around the axis 12.

Ring 5 comprises an inner eccentric recess of circular shape whose center is eccentric with respect to axis 12 which represents the axis of rotation of ring 5. This eccentric recess brings ring 5 hereinafter referred to as an eccentric.

A driveshaft 9 and eccentric ring 5 are interdependent in rotation.

A notably disk-shaped part 6 is inscribed in the eccentric recess. Part 6 comprises an oblong port 10 dimensioned for cooperating with the faces 14 and 15 of the lever arm. This port is preferably centred on the axis of part 6.

The guiding means can be located some place other than at the level of lever arm 7 without departing from the scope of this invention and, for example, the guiding members can be placed substantially at the level of the ball joint knuckle 3 or even on the other side from lever arm 7 with respect to the knuckle.

Using lateral guiding methods other than the one comprising a port 11 can be done without departing from the scope of the invention.

The principle of the device shown in FIG. 1 is the following:

The guiding means hold the angular displacement of the lower element within a single plane containing the axis 12 of the upper element. In order to simplify FIG. 1 and the description of the principle of the present invention, a guiding means which besides excludes the rotating of the lower element around the longitudinal axis 13 thereof is shown as an example. This does not limit the principle which is notably based on the fact that the guiding faces of the port 10 of the part 6 must remain perpendicular to the displacement plane and parallel to axis 13. This is particularly the case when the mechanical clearances are wished to be reduced. In the example described in FIG. 1, faces 14 and 15 are fixed in rotation by the guiding means and the cooperating of faces 14 and 15 with port 10 indexes the position of part 6 in the desired direction.

Using other means for indexing the angular position of part 6 can be done without departing from the scope of this invention.

When driveshaft 9 is rotated by one turn, the rotation through 360° of eccentric 5 around axis 12 makes the center of the part 6 describe a circle whose radius has the value of the eccentricity of the recess of ring 5.

The faces 14 and 15 which remain within the plane perpendicular to the displacement plane of the lever arm are substantially driven, through the cooperating of the port 10 of part 6, in a translation motion on either side of axis 12. The lower element, linked to the faces by the lever arm, is displaced thereby in an angular manner around the knuckle and in the displacement plane. The value of the disalignment angle is (i), an angle between axis 12 and axis 13.

Figure 2:
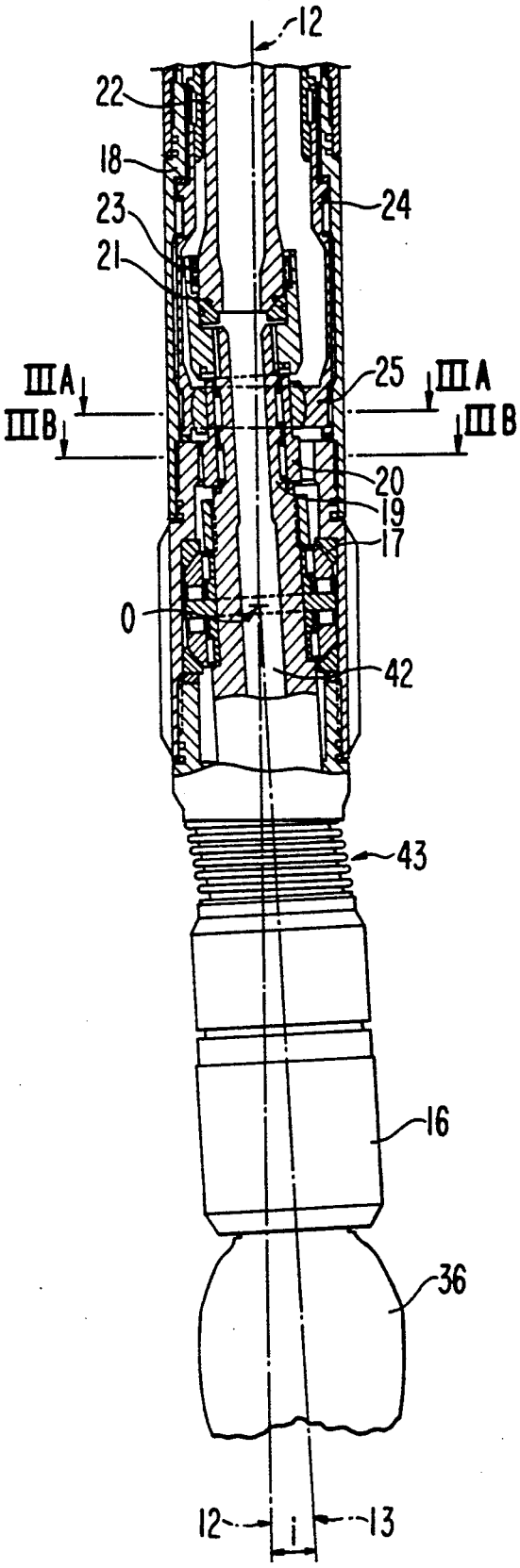
FIG. 2 is a cross-sectional schematic view of the device of the present invention applied to a drilling bent sub.

As shown in FIG. 2, a lower element 16 is assembled on the upper element 18 by a ball joint 17. This type of connection shows great advantages for obtaining a high mechanical strength which is essential for this device. In fact, be it in traction or compression, the stresses can be distributed over a large surface due to the spherical shape of the knuckle. Besides, since the lower element 16 can rotate around the axis 13 thereof, the structure of the knuckle comprises two hemispheres confining a bidirectional roller thrust linked to the lower element 16.

A channel 42 thoroughly crosses lower element 16, with a lever arm 19 comprising at the end thereof a bushing 20 concentric to the axis 13 being mounted on bearings. A supple or tight joint 21 cooperates with a pipe 22, with a system 23 of connection and rotation immovably linking in rotation the pipe 22 with the lower element 16 by the upper part of the lever arm 19, and pipe 22 functioning as a shaft transmitting the turning moment to the lower element. A lateral guiding system, disposed substantially at the level of the section line IIIB—IIIB is immovably attached to the upper element 18. The lateral guiding system comprises two sectors 28, 29 immovably attached to the body of the upper element. These two sectors cooperate with two flat parts 31, 32 of the bushing 20. The guiding system is thereby removed a sufficient distance from the knuckle in order to better withstand mechanical stresses and, in particular, bending stresses.

A means for controlling the disalignment angle at the level of the plane defined by the section line IIIA—IIIA. It comprises a ring 25 whose outer surface is concentric to the body of upper element 18. This ring comprises a recess 30 having the shape of the truncation of a sphere. The center of this recess is eccentric with respect to axis 12. A driveshaft 24 is immovably attached in rotation to the eccentric ring 25. The shaft-ring assembly is mounted on coaxial bearings with the body of the upper element. Sectors 26 and 27 complementary to the shape of the recess fasten laterally bushing 20 by means of the flat parts 33 and 34. The flat parts 33 and 34 are perpendicular to the other couple of flat parts 31 and 32 of the same bushing. Sectors 26 and 27 are free to slide within recess 30, notably in the plane perpendicular to axis 13 and passing through the center of the sphere truncation of recess 30.

A supple tube 43 is fastened on one side to the lower end of the upper element and on the other side to lower element 16 in order to isolate the bore of upper element 18 from the outer environment is which the device of the invention is disposed.

The driveshaft 24 is connected by coupling means with a remote operating equipment such as the one disclosed in French patent 2,641,320.

Figure 3A:
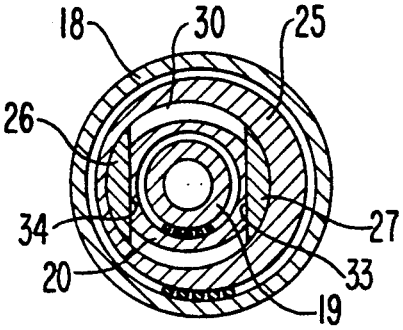
FIGS. 3A and 3B are cross-sectional views respectively taken along the lines IIIA—IIIA and IIIB—IIIB in FIG. 2.

As shown in FIG. 3A, an eccentric 25 comprises a recess 30 which is off center with respect to the axis of the upper element, with parts 26 and 27, having a semicircular cross section, holding the position of the bushing 20 in the eccentric recess 30.

Figure 3B:
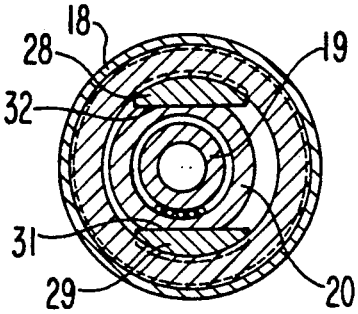

As shown in FIG. 3B, the parts 28 and 29 guide, by means of the bushing 20, the lower element 20 in an X-Y plane, with parts 28 and 29 being immovably attached to the upper element 18.

Figure 4:
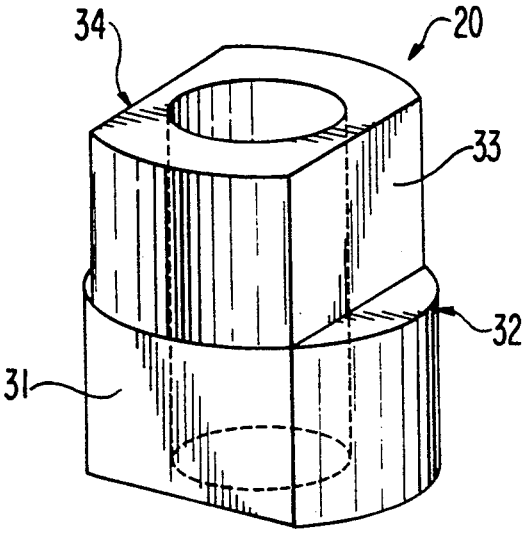
FIG. 4 is a perspective detail view of the pushing and the faces cooperating with the guiding control means according to the present invention.

The bushing of FIG. 4 is mounted on bearings on the lever arm thereby leaving the lower element 16 free to rotate around the axis thereof while being displaced in an angular manner by the eccentric. Faces 31 and 32 cooperate with parts 28 and 29, with faces 33 and 34 cooperating with parts 26 and 27.

Figures 5A, 5B, 5C, 5D, 5E:
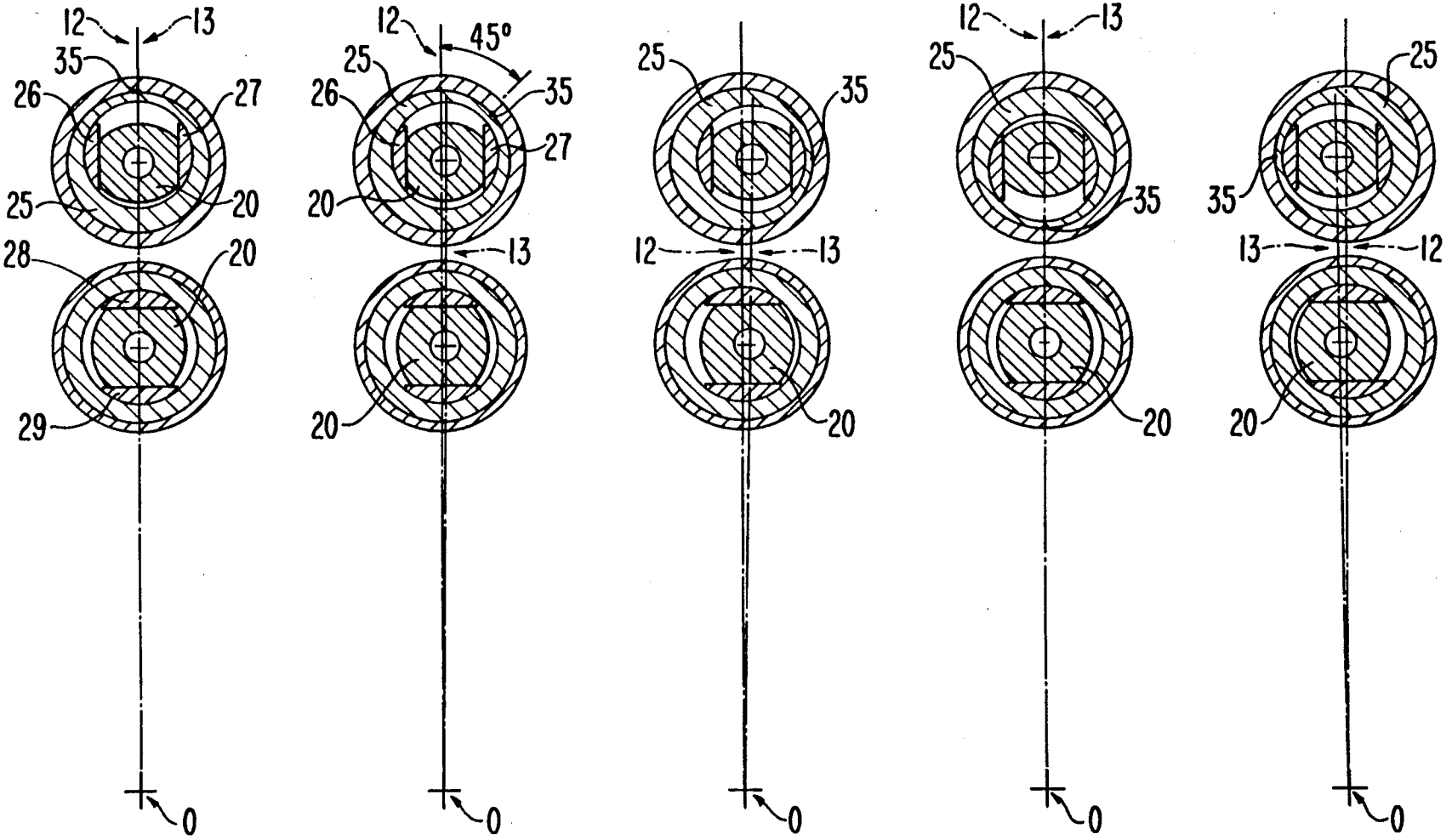
FIGS. 5A, 5B, 5C, 5D and 5E are cross sectional views respectively illustrating five rotational positions of the ring of the present invention as viewed in the planes taken along the lines IIIA—IIIA and IIIB—IIIB in FIG. 2.
Figure 6:
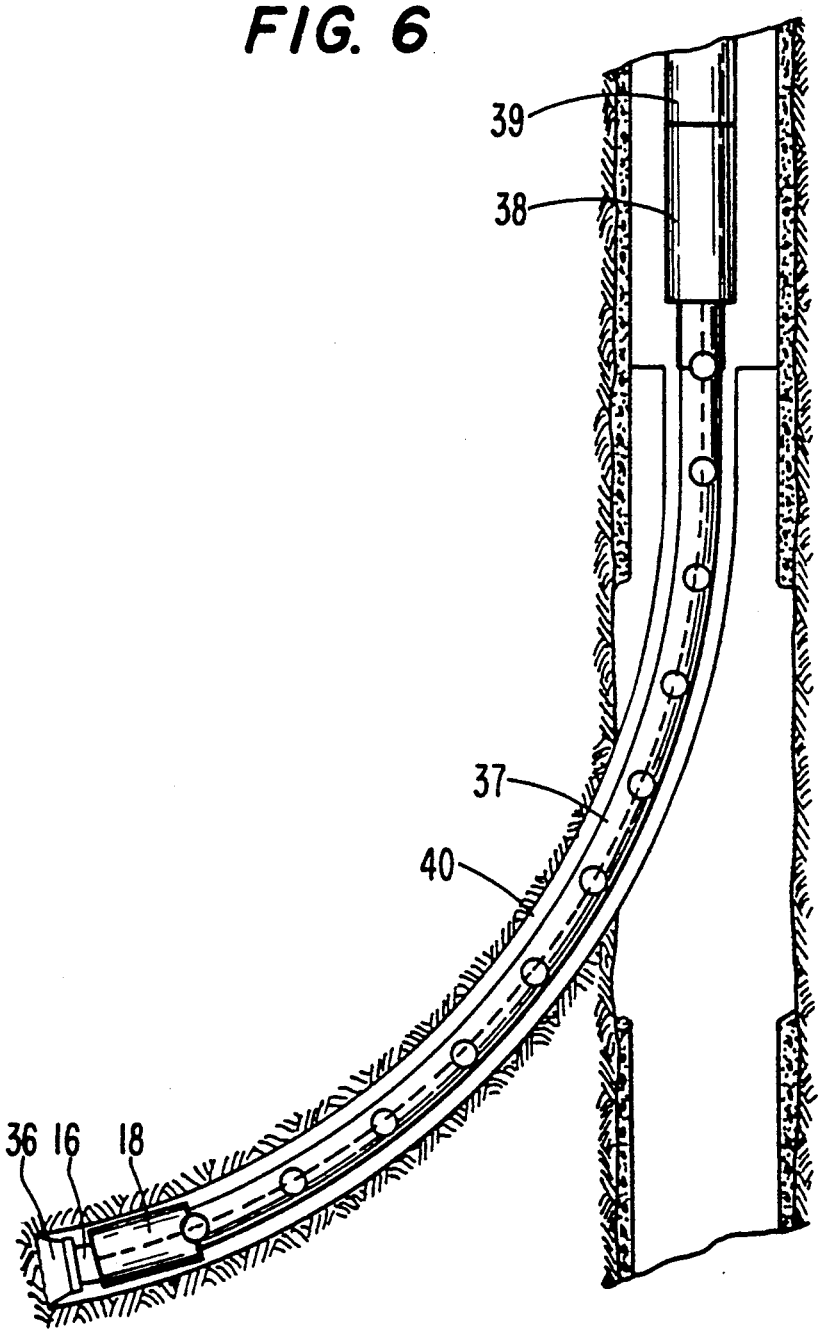
FIG. 6 is a schematic view of the device of the present invention applied to inclination drilling.

FIGS. 5*a*, 5*b*, 5*c*, 5*d* and 5*e* show the relative positions of the axis 13 of the lower element with respect to the axis 12 of the upper element by figuring the two sections IIIB—IIIB and IIIA—IIIA respectively at the level of the lateral guiding and at the level of the displacement device. The bushing is not shown for the sake of clarity. Mark 35 allows to visualize the rotation of the eccentric:

As shown in FIG. 5*a*, with the mark 35 is in the plane perpendicular to the displacement plane of the lower element, the axes 12 and 13 merge, In FIG. 5*b*, the eccentric has then rotated through 45° and the axis 13 is offset from axis 12 by an intermediate angle, and in the same motion sectors 26 and 27 have slided in relation to the faces of the bushing.

In FIG. 5*c*, the eccentric has through 90° and the axis 13 has reached the maximum angular displacement on the side of mark 35.

In FIG. 5*d*, the eccentric has performed a total rotation through 180°, and axes 12 and 13 merge as in FIG. 5*a*.

In FIG. 5*e*, the eccentric has performed a total rotation through 270°, the angular displacement of 13 with respect to 12 has reached the maximum thereof, but on the side opposite the one of FIG. 5*c*.

The components of the device can be arranged and constructed so that the angular variation between axes 12 and 13 occurs only between a zero value and a maximum angle value, and in a single direction, without departing from the scope of this invention. In fact, it is often useful to have, as shown in FIGS. 5*c* and 5*e*, an angular eccentricity on either side of the coaxial position shown in FIGS. 5*a* and 5*d*. This can be easily done, for example, through an adapted drawing of the lower element 1, 16 with respect to the lever arm 7, 19.

A drill bit 36 screwed onto lower element 16 allows the drilling of a well 40 of a curved trajectory. An upper element 18 is connected with articulated elements 37.

Figure 8:
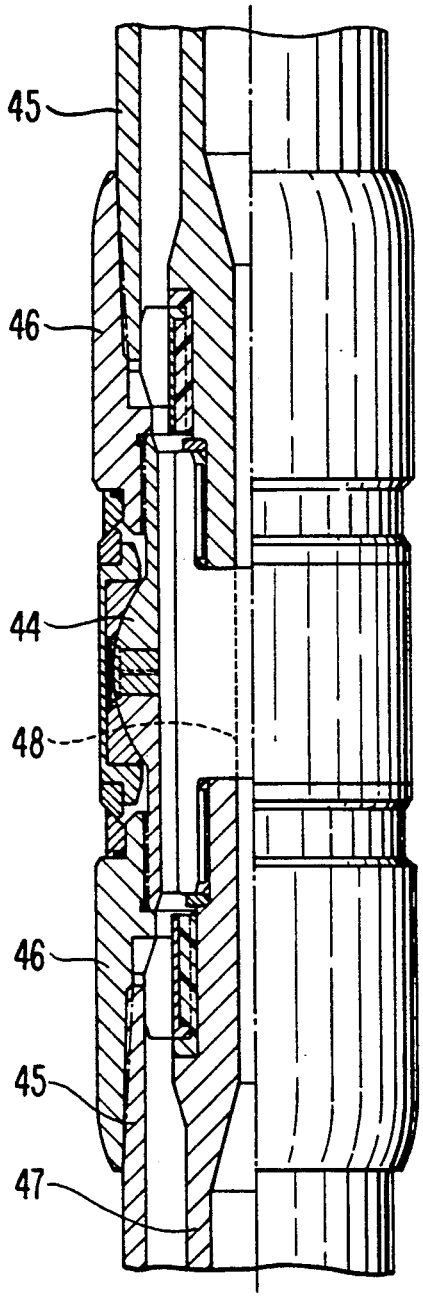
FIG. 8 is a partial cross-sectional view of articulated elements in the device of the present invention.
Figure 8A:
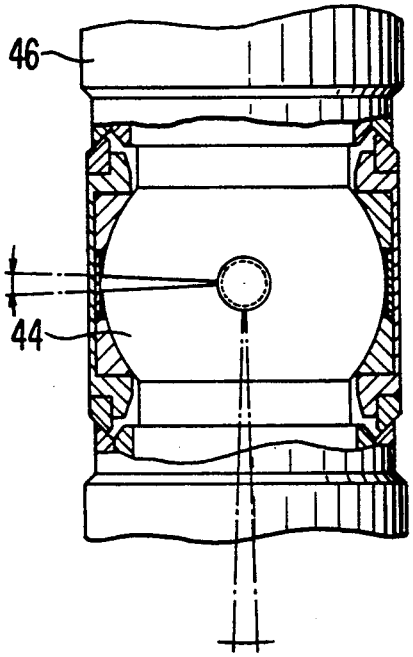
FIG. 8A is a front view of a knuckle of the articulated element of FIG. 8.

As shown in FIG. 8, the ends of the tubes 45 are threadably attached to subs 46 comprising in the central part thereof a plane knuckle 44. The knuckles 44 of the articulated elements 47 are all in the same plane so that the deformation of the supple assembly constituted thereby substantially forms an arc of a circle. The obtained curvature is set by the angular displacement of each ball joint and the tube length of each element between two subs 46. Elements 37 are hollow in order to contain a supple shaft transmitting the turning moment to the lower element of said device. FIG. 8 shows a driveshaft comprising steel pipes 47 assembled at the level of subs 46 by universal type joints 48. This driveshaft transmits the turning moment of the rotor of downhole motor 38 to the pipe 22 of said device.

Figure 9:
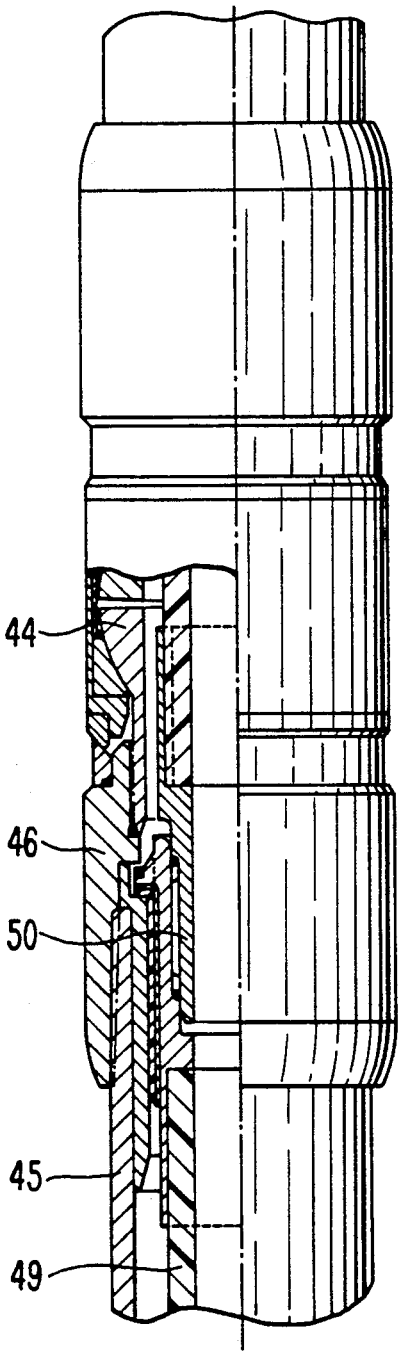
FIG. 9 is a partial cross-sectional view of another embodiment of articulated elements of the device comprising a drive shaft made of a composite material.
Figure 9A:
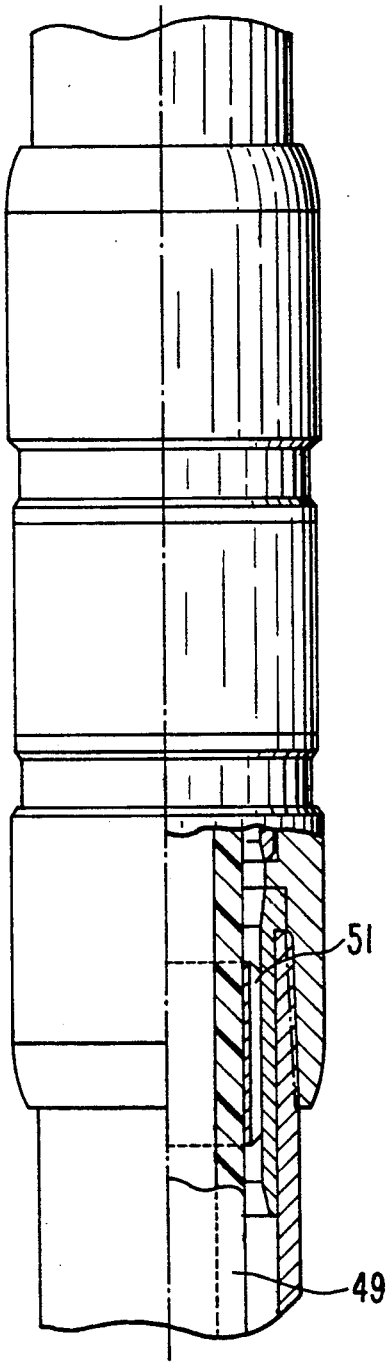
FIG. 9A is a partial cross-sectional view of a guide for a composite drive shaft.

FIGS. 9 and 9A show another embodiment of the present invention including articulated elements comprising a driveshaft made of a composite material supple enough not to require an articulated universal type joint. FIG. 9 provides an example of a tie-in 50 of the tubes made of composite material 49, with FIG. 9A showing a guiding 51 of the composite material tube at the level of a coupling of articulated elements 37.

Figure 7:
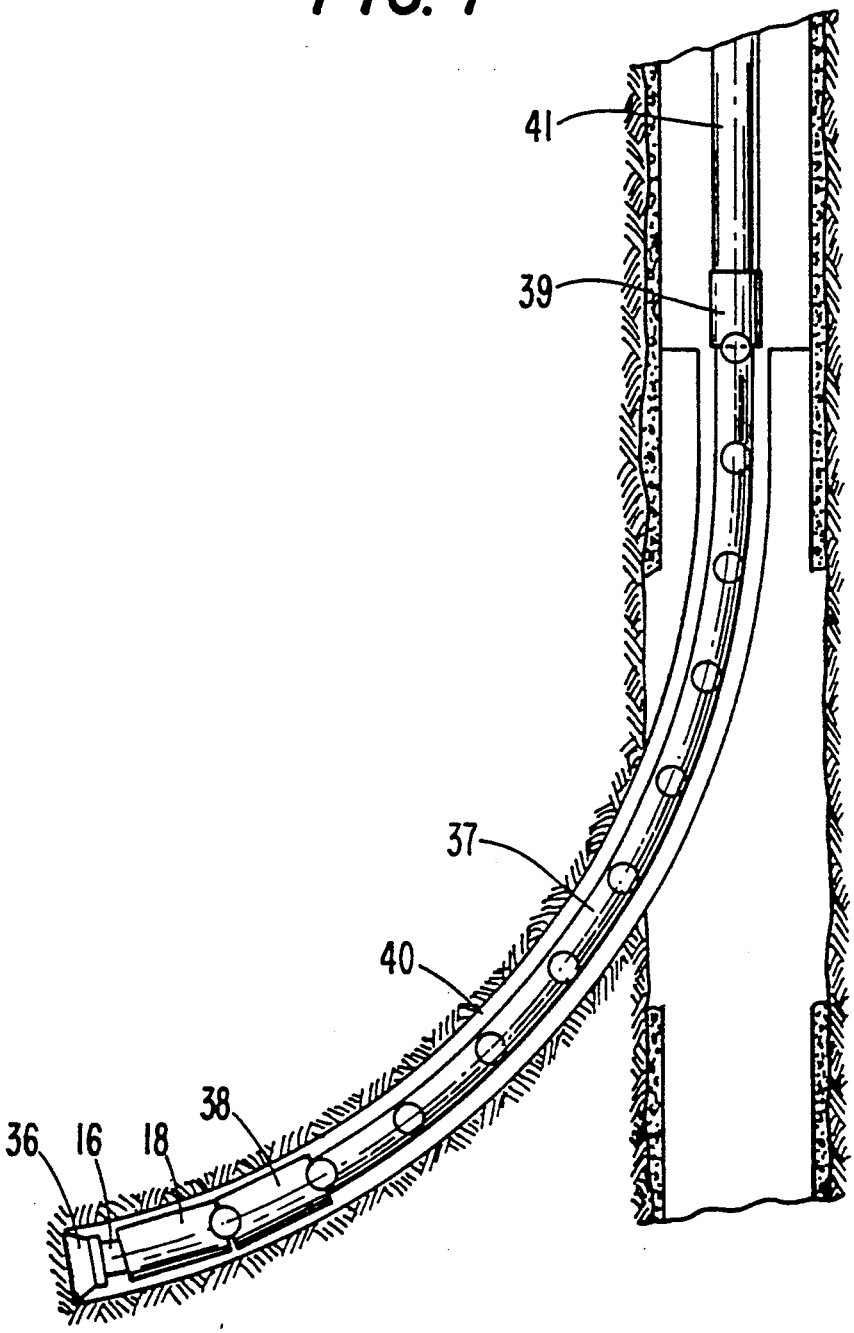
FIG. 7 is a schematic view of another embodiment of the device of the present invention applied to inclination drillings.

FIG. 7 provides an illustration of an application of the device of the invention to inclination drilling, with the following lay-out of equipment as viewed from the bottom in an upward direction. More particularly, a drill bit 36 is threadably attached onto a lower element, with a downhole motor being threadably attached to an upper element, followed by articulated elements 37, drill collars 39, and then drill pipes 41 up to the surface.

In the situations where the downhole motor is either threadably attached to the upper element of the device or threadably attached to the lower element, a downhole motor type having a length comparable to the length of the articulated elements 37 is preferably used.

In the two previous cases, the articulated elements do not need to comprise a supple shaft for transmitting the turning moment, but simply to allow a circulation of a fluid under pressure to the drill bit.

I claim:

1. A device for enabling two elements connected by a knuckle to take a disalignment angle with respect to one another, in a single displacement plane, a lower element of the two elements extends beyond the knuckle shaped as a lever arm located in a hollow upper element forming the second element of the two elements, wherein the knuckle a ball joint type, said device comprises guiding means holding the displacement of the two elements in said displacement plane, said means being integrated into the upper element, said device also comprises, in the upper element, means for controlling said disalignment angle, and wherein said control means comprise an eccentric whose position determines said disalignment angle.

2. A device as claimed in claim 1, wherein said controlling means further comprises a substantially ring-shaped part having an inner recess, in which said lever arm is positioned, with a straight-line section of a circular shape whose center is offset with respect to an axis of the upper element wherein, at the level of said ring, said lever arm comprises two faces symmetric with respect to a longitudinal axis thereof and perpendicular to the displacement plane of the two elements, and wherein said recess comprises a part guided in rotation by said recess and comprising itself a substantially oblong port cooperating with said faces of the lever arm.

3. A device as claimed in one of claims 1 or 2, wherein the lower element is hollow and comprises, at an upper end of said lever arm, a supple and tight connection with an end of a pipe for allowing a fluid to circulate through the lower element.

4. A device as claimed in one of claims 1 or 2, wherein the lower element is rotatable around the axis thereof, said lever arm cooperates with at least one coaxial bushing, and wherein said bushing has a fixed angular position with respect to said displacement plane.

5. A device as claimed in claim 3, wherein the pipe is a hollow shaft transmitting a turning moment to the lower element.

6. A device as claimed in claim 4, wherein said guiding and control means comprise systems of ports and faces, and wherein at least one of said faces are carried by said bushing.

7. A device as claimed in claim 2, wherein the part guided in rotation by said recess comprises two identical sectors filling in the two spaced delimited by each face and the inner recess of the ring, wherein the recess has the shape of a symmetric truncation of a sphere, and wherein said sectors are sectors of the truncation of said sphere.

8. A device as claimed in one claims 1 or 2, wherein the upper element comprises a drive shaft which is concentric with respect to it, and said shaft is immovably attached to the ring in rotation.

9. A device as claimed in one of claims 1 or 2, comprising remote control means for the means for controlling the disalignment angle of the two elements.

10. A device as claimed in one claims 1 or 2, wherein the device is incorporated in equipment integrated in a drill string.

11. A device as claimed in claim 10, wherein the device cooperates with a drill bit threadably attached to the lower element, with a downhole motor, and assembly of articulated elements, drill collars and drillpipes.

12. A device as claimed in claim 11, wherein the drill string comprises, from a lower end thereof, a drill bit, said device, a downhole motor, the articulated elements, the drill collars, and the drillpipes, and wherein the downhole motor and the articulated elements can be inverted.

13. A device as claimed in claim 10, wherein the drill string comprises a downhole motor threadably attached to the lower element of said device, and wherein a drill bit is threadably attached to a rotor of said motor.

* * * * *